United States Patent [19]

Meulendyk

[11] 3,956,971

[45] May 18, 1976

[54] STABILIZED HYDROMECHANICAL SERVO SYSTEM

[75] Inventor: John W. Meulendyk, Kalamazoo, Mich.

[73] Assignee: Pneumo Corporation, Boston, Mass.

[22] Filed: May 24, 1974

[21] Appl. No.: 473,134

[52] U.S. Cl. ..... 91/384; 91/387; 251/50

[51] Int. Cl.[2] ..... F15B 13/16; F15B 9/10

[58] Field of Search ..... 91/387, 384, 363 A; 251/50

[56] References Cited

UNITED STATES PATENTS

| | | | |
|---|---|---|---|
| 2,613,890 | 10/1952 | Beman | 91/384 |
| 2,940,699 | 6/1960 | Plummer | 91/363 A |
| 3,003,719 | 10/1961 | Summerlin et al. | 91/384 |
| 3,176,721 | 4/1965 | Gordon | 251/50 |

*Primary Examiner*—Paul E. Maslousky
*Attorney, Agent, or Firm*—Donnelly, Maky, Renner & Otto

[57] ABSTRACT

A hydromechanical servo system having mechanical feedback is stabilized by damping the control valve and providing limited motion yieldable means for allowing limited yielding movement of feedback means relative to biasing means which biases such feedback means to a passive position.

17 Claims, 8 Drawing Figures

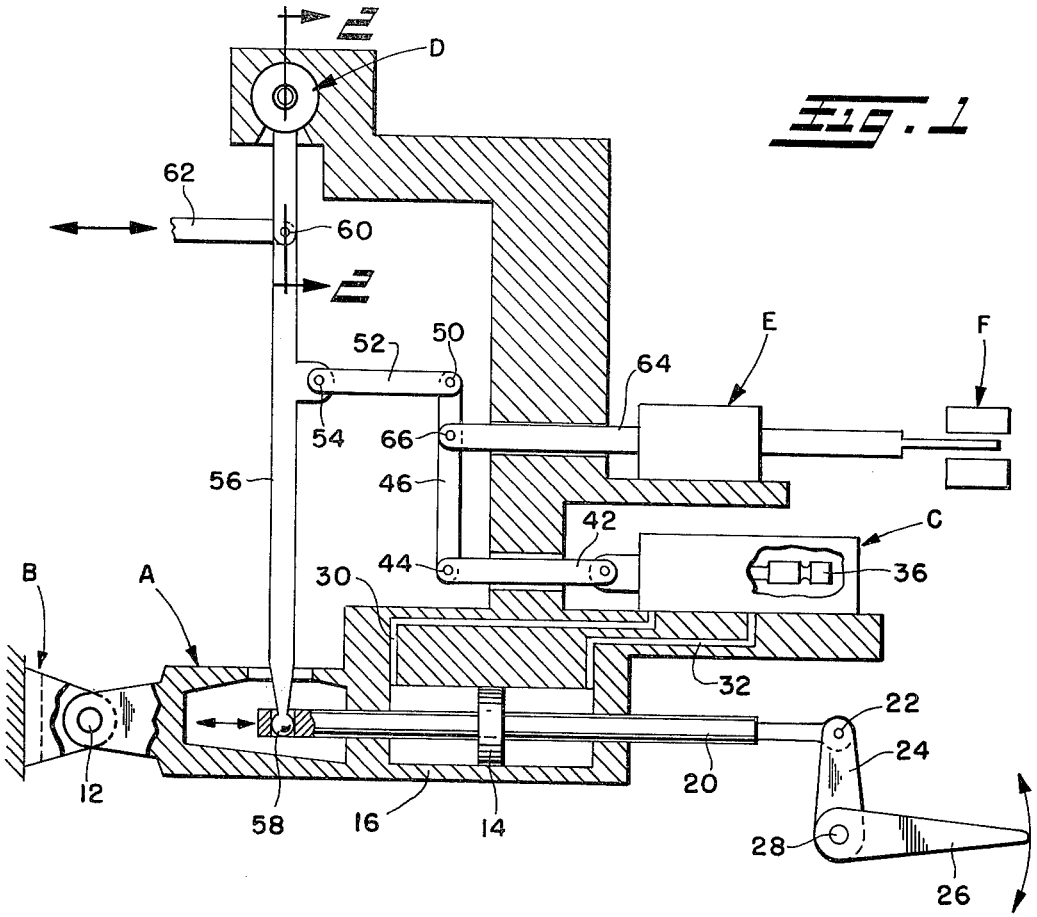
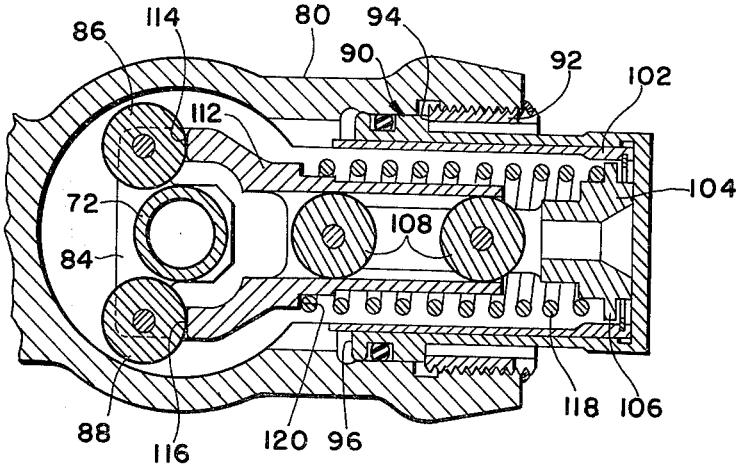
Fig. 3

STABILIZED HYDROMECHANICAL SERVO SYSTEM

BACKGROUND OF THE INVENTION

This invention pertains to the art of hydromechanical servo systems, and more particularly to such a system having mechanical feedback.

Hydromechanical servo systems often exhibit dynamic performance which is marginally stable or unstable. This is usually due to intercoupling of the load mass with spring rates of structures and hydraulic fluid which are part of the servo systems.

Stability margins may be improved by various methods. One method which is highly effective and imposes little or no penalty in system weight or performance involves the use of structural feedback compensation. This method is widely used in aircraft flight control servo systems and is described in a paper entitled "Improvement of Power Surface Control Systems By Structural Defelection Compensation" by James J. Rahn and Everett W. Kangas, published in Report of the Second Piloted Aircraft Flight Control System Symposium by Bu Aer, Report No. AE-61-5, June, 1952, Volume III, page 107.

Recently, extreme emphasis has been placed upon assuring "survivability" of military aircraft flight control integrity. One means toward this end includes incorporation of detent means in the control linkage of flight control servo units.

In the event that the mechanical linkage path from cockpit to servo unit is disconnected, due to failure or due to battle damage, such a detent would hold the servo unit, and thus the flight control surface, in a preferred passive position. However, this detented or "fail-safe" condition, with normal linkage path disconnected, renders the structural feedback compensation inoperative and the system may now be marginally stable or unstable.

SUMMARY OF THE INVENTION

The hydromechanical servo system of the present invention includes biasing means for biasing its output to a passive position in the event of failure in the mechanical control between the command point and the servo system. A summing link is connected with the mechanical control and servo valve, and under emergency conditions when the mechanical control linkage is inoperative, loads acting on the controlled member tend to move the control valve under forces acting through the summing link.

In accordance with the present invention, limited motion yieldable means is provided between the summing link and biasing means to permit limited movement of the summing link without operating the valve under certain dynamic conditions.

In accordance with another aspect of the invention, the valve is damped so that the limited motion yieldable means moves before the valve can be operated under certain dynamic conditions.

In accordance with one arrangement, the limited motion yieldable means comprises a cantilevered spring rod connected between the biasing means and the input point of the servo system, and the valve damping means comprises a hydraulic fluid chamber at one end portion of the valve spool. Restrictor valves communicating with the chamber permit entrance or escape of hydraulic fluid relative to the chamber only under predetermined force applied to hydraulic fluid in the chamber by the valve spool.

It is accordingly a principal object of the present invention to provide a stabilized hydromechanical servo system.

An additional object of the invention is to provide stability for a backup control mode when failure of the primary control mode has rendered the normal control mode inoperative.

Another object of the invention is to provide a hydromechanical servo system having a higher degree of stability than previous systems.

A further object of the invention is to stabilize a hydromechanical servo system in a very simple manner.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWING

The invention may take form in certain parts and arrangements of parts, a preferred embodiment of which will be described in detail in this specification and illustrated in the accompanying drawing which forms a part hereof.

FIG. 1 is a schematic illustration of a hydromechanical servo system having the improvements of the present invention incorporated therein;

FIG. 3 is a cross-sectional elevation view looking generally in the direction of arrows 3—3 of FIG. 2;

FIG. 6 is a graph showing a typical damping force operating characteristic used to achieve the improvements of the present invention;

DESCRIPTION OF A PREFERRED EMBODIMENT

Figure 5:
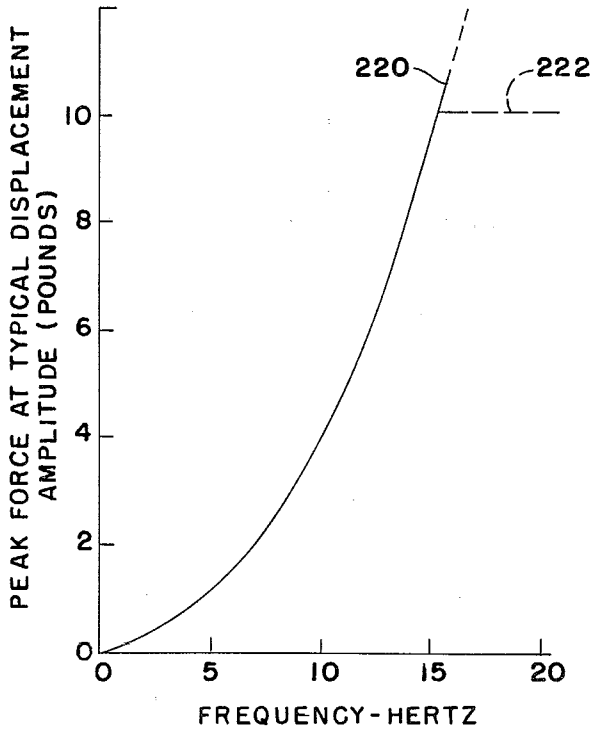
FIG. 5 is a graph illustrating a typical spring force characteristic used to achieve the improvements of the present invention.

Referring now to the drawings, wherein the showings are for purposes of illustrating a preferred embodiment of the invention only and not for purposes of limiting same, FIG. 1 schematically shows a hydromechanical servo system having the improvements of the present invention incorporated therein.

The servo system may be considered as having a mounting member or body A secured to a support B at connection 12. Piston 14 is reciprocatingly positioned in cylindrical bore 16 and includes a piston rod 20 pivotally connected as at 22 with a link 24 attached to an aerodynamic controlled member 26 or the like on an aircraft. Link 24 and controlled member 26 are pivotal about axis 28.

A selectively operable valve C is connected through fluid lines or conduits 30 and 32 with piston bore 16 for selectively extending or retracting piston 14 to position controlled member 26 in a desirable attitude. Valve C includes a shiftable spool 36 for selectively opening one of conduits 30 or 32 to provide high pressure hydraulic fluid to one end of piston bore 16, while the other end is opened to a return reservoir through the other conduit. A link 42 is suitably connected for shifting spool 36 of valve C and is connected at 44 with link 46 which in turn is pivotally connected at 50 with link 52. Link 52 is pivotally connected at 54 with a summing link 56 which is connected at one end as at 58 with piston rod 20, and pivotally connected at its other end as at 60 with mechanical control input link 62 and biasing means D. A link 64 is pivotally connected at 66 to link 46 and with a control augmentation device E for selectively positioning valve C. Link 64 may also be associated with a feedback device F. Pivot connection 60 represents the input point between biasing means D and the servo system.

Piston 14 and its bore 16, valve C, biasing means D and control augmentation device E and feedback device F are all mounted to, or form part of, body A.

A suitable control may be provided in an aircraft cockpit for shifting link 62 either to the right or left in FIG. 1, thus to pivot summing link 56 about connection 58 for shifting link 52 either to the right or left. This selectively positions valve spool 36 to extend or retract piston 14. When piston 14 moves, connection 58 with summing link 56 also moves to provide a mechanical feedback which is summed with the position of connection 60 in order to return valve C to a neutral position when the desired position of piston 14 has been achieved.

In the event of failure in the mechanical control from the cockpit through link 62, biasing means D is arranged for biasing connection 60 to a passive position. That is, biasing means D will bias connection 60 to a predetermined set position and provide proper control of valve C for moving piston 14 to a corresponding predetermined position and holding it there. Such predetermined position can be modified by operation of control augmentation device E. This will locate controlled member 26 in a passive attitude so that the aircraft will remain airborne. Biasing means D also provides a hard point against which control augmentation device E can work in positioning valve C and thus controlled member 26 for active control of aircraft attitude.

When failure occurs in mechanical controls of existing systems, and biasing means D operates to move connection 60 and valve C to a passive position, piston 14 will be held in a preferred passive position. Subsequent to such operation, loads acting on controlled member 26 impart energy to inertia masses within the servo system, for example, the mass of member 26. In addition, the connections at 22 and 12 and support B react somewhat as structural springs. For example, an air load acting vertically downward on controlled member 26 in a failed condition of the servo system will tend to pull piston 14 to the right. This force is also transmitted to summing link 56 and tends to shift spool 36 for opening conduit 32 and supplying hydraulic fluid forwardly of piston 14. Thus, valve C is operative to supply hydraulic fluid to piston 14 in opposition to the force tending to shift the piston. With such an arrangement, valve C adds hydraulic fluid energy to the system just at the time significant spring-mass energy has been stored within the system. Addition of such hydraulic fluid energy, in combination with the tendency toward oscillation of the system due to the spring-mass energy, makes the system marginally stable or unstable.

In accordance with the present invention, the servo system is stabilized by limiting displacement of valve C under failed conditions due to small oscillations and forces which occur at predetermined adverse frequencies. In accordance with one arrangement, shown most clearly in FIG. 2, biasing means D includes a crank 70 secured to a rotatable shaft 72 by pin 74. Shaft 72 is rotatably journaled in bearings 76 and 78 in housing 80. As shown in FIG. 3, shaft 72 has a bifurcated member 84 secured thereto rotatably carrying a pair of spaced-apart rollers 86 and 88. A spring cartridge 90 is secured within housing 80 by retaining member 92 bearing against shoulder 94 on cartridge 90. Cartridge 90 may have another shoulder 96 engaging a stop on housing 80. A sleeve member 102 positioned within cartridge 90 receives a rod member 104 having an outwardly extending flange 106 and a pair of spaced-apart rotatable rollers 108. A hollow slide member 112 receives rollers 108, and has end portions 114 and 116 bearing against rollers 86 and 88, respectively. A coil spring 118 within sleeve 102 bears against shoulder 106 of rod member 104 and against shoulder 120 on slide member 112 for normally biasing slide member 112 to the left in FIG. 3 against rollers 86 and 88 for rotating crank 70 to a predetermined passive position in the event of failure in the mechanical control. Normal operation of the mechanical control causes rotation of crank 70 and shaft 72 for reciprocating slide member 112 against the force of spring 118 by action of rollers 86 and 88. Biasing means D may be suitably supplied with hydraulic fluid for lubrication.

With the arrangement described, if a failure in the mechanical control should occur, the biasing means D will bias crank 70 to the predetermined passive position under the force of powerful spring 118. Loads acting on controlled member 26 then cause feedback through summing link 56 which tends to operate valve C because the spool of valve C is more easily shifted than is connection 60 against the force of spring 118. Thus, member 26 is maintained in the desired position. In accordance with the present invention, limited motion yieldable means is provided between summing link 56 and biasing means D for allowing limited yieldable motion of connection 60 before bottoming against powerful spring 118.

Figure 2:
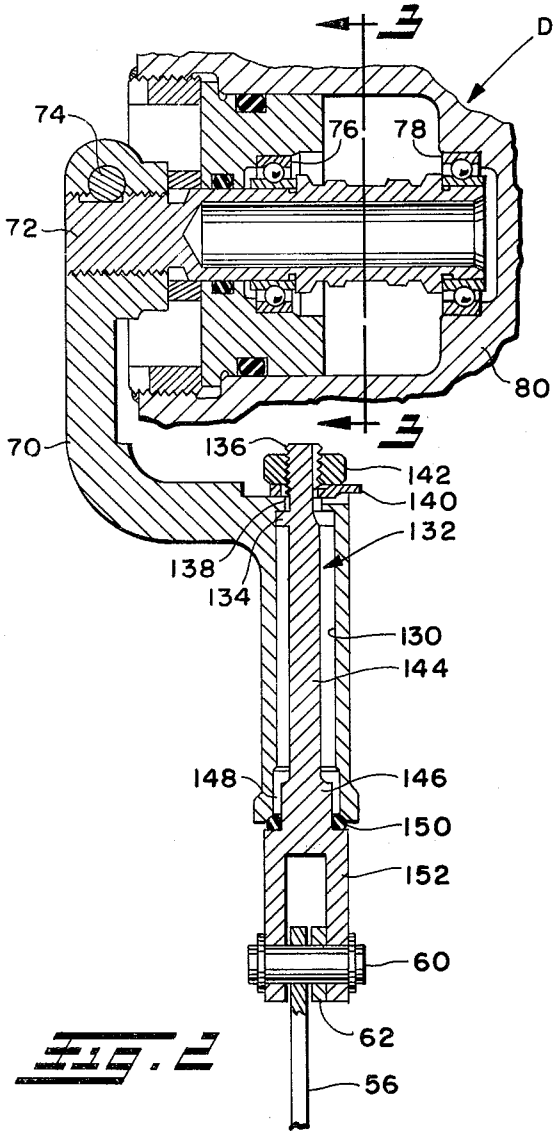
FIG. 2 is a cross-sectional elevation view looking generally in the direction of arrows 2—2 of FIG. 1.
Figure 4:
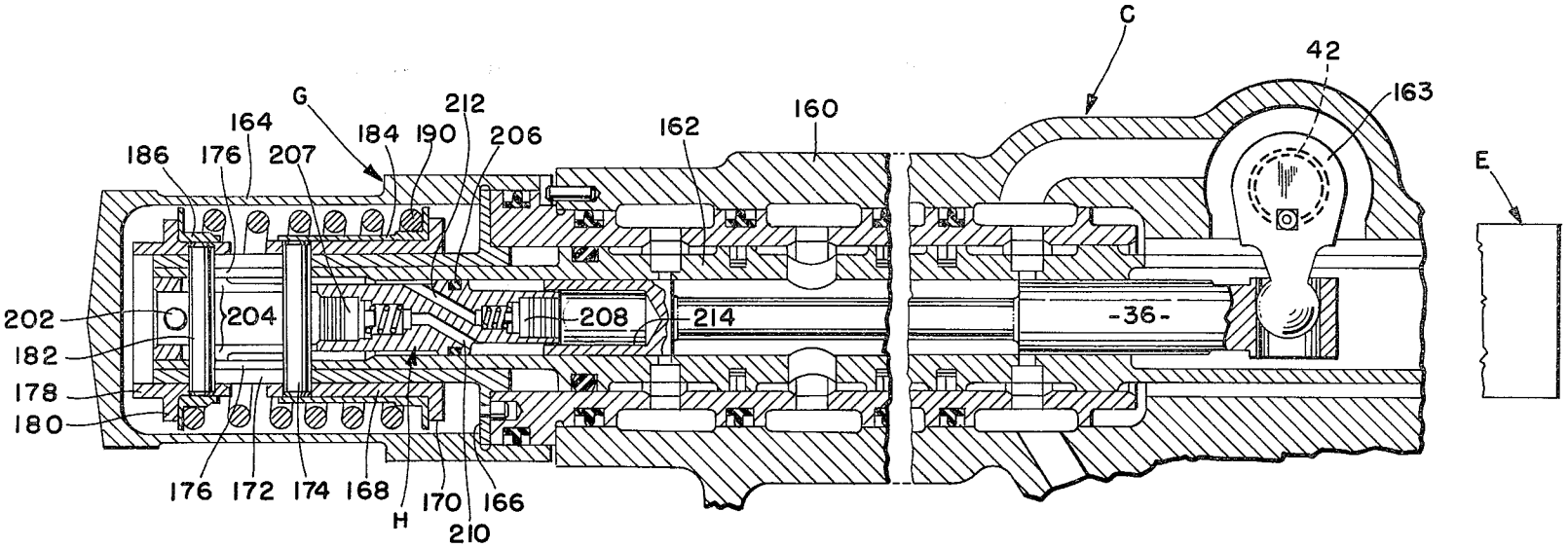

In accordance with one arrangement, the limited motion yieldable means includes an elongated socket or cylindrical portion 130 on crank 70 (see FIG. 2). An elongated spring rod 132 is centrally positioned within socket 130. Spring rod 132 includes an outwardly extending flange 134 bottomed in socket 130 and having a diameter substantially the same as the diameter of socket 130. A threaded end portion 136 on spring rod 132 extends through a suitable hole 138 in the bottom of socket 130 for engagement by a lock washer 140 and nut 142 which secure one end portion of spring rod 132 to the bottom of socket 130.

Spring rod 132 includes a small diameter portion 144 extending over a major portion of the length of socket 130, and a somewhat larger diameter portion 146 near the opposite end portion of socket 130. Larger diameter portion 146 provides a limited peripheral clearance 148 between its outer peripheral surface and the inner peripheral surface of socket 130. An O-ring 150 may be positioned around larger diameter portion 146 for keeping dirt out of socket 130.

Spring rod 132 has a bifurcated end portion 152 to which links 56 and 62 are connected by pin 60. With the arrangement described, it will be recognized that spring rod 132 defines a cantilevered spring which is cantilevered about its bottom end portion so that its bifurcated outer end portion 152 may move relative to socket 130. The diameter and length of small diameter portion 144 on spring rod 132 are chosen so that bifurcated end portion 152 may shift by bending of rod 132 relative to socket 130 before spring 118 will be compressed. In other words, spring rod 132 is a less powerful biasing force than spring 118.

With such an arrangement, under conditions of failure in the mechanical control system, biasing means D will bias connection 60 to a preferred passive position. Loads acting on controlled member 26 tending to shift piston 14 then transmit motion and force through summing link 56 to connection 54 leading to valve C and to connection 60. At predetermined frequencies the limited motion yieldable means defined by spring rod 132 provides less resistance to movement than valve C so that limited movement of connection 60 may occur before valve C will operate for supplying hydraulic fluid to piston bore 16. With this arrangement, oscillation at critical frequency is minimized. After slight yielding movement, portion 146 of spring rod 132 will bottom out against the inner wall of socket 130 so that spring 118 will be compressed and valve C will be operated. However, minor oscillations of the system at critical frequency are accommodated by the defined limited motion yieldable biasing means without significantly displacing valve C. In the failed condition of control input 62, powerful spring 118 provides a hard point for operation of valve C by control augmentation device E.

In accordance with another aspect of the invention, valve C is preferably damped to inhibit its operation so that the defined limited motion yieldable means may operate to absorb and accommodate slight oscillations. The valve damping means prevents significant displacement of the valve spool at predetermined frequencies without application of relatively high force thereto. As shown in greater detail in FIG. 4, valve C includes a housing 160 in which valve spool 36 is slidably positioned within valve sleeve 162. Crank 163 is operatively associated with link 42 and spool 36 for shifting such spool. Damping means G is provided at one end portion of valve housing 160. In accordance with one arrangement, a cartridge 164 is suitably secured to one end of valve housing 160. A sleeve member 166 is secured within cartridge 164 to one end portion of valve C. A cylindrical member 168 having an outwardly extending flange 170 is positioned over sleeve 166. Sleeve 166 has elongated opposite slots 172 therein through which a pin 174 extends. The ends of pin 174 are secured in suitable holes in cylindrical member 168. Valve sleeve 162 also has elongated opposite slots 176 therein through which pin 174 extends. Another cylindrical member 178 is positioned on sleeve member 166 and has an outwardly extending flange 180. A pin 182 extends through slots 172 and 176, and is fixed in suitable opposite holes in cylindrical member 178. Cylindrical slide members 184 and 186 are positioned over cylindrical members 168 and 178, and a coil spring 190 is interposed therebetween for normally biasing slide members 184 and 186 against flanges 170 and 180. Cylindrical members 168 and 178 are then normally biased to positions wherein pins 174 and 182 are bottomed out at the ends of slots 172 and 176. Valve sleeve 162 may act against either pin 174 or 182 to shift cylindrical member 168 to the left or member 178 to the right for compressing spring 190.

Damping means G includes a piston member H positioned within valve sleeve 162. Piston H is secured against movement relative to valve sleeve 162 by pin 202 extending through suitable elongated slots in valve sleeve 162 and into holes in sleeve member 166. This allows limited movement of valve sleeve 162 relative to pin 202, while piston H is fixed against movement because of its pinned connection to sleeve member 166. Piston H has opposite elongated slots 204 aligned with slots 172 and 176, said pins 174 and 182 extending through all of the defined slots. Piston H has a suitable seal 206, on the opposite sides of which are suitable check valve assemblies 207 and 208. Ports 210 and 212 provide communication between restrictor-check valves 207 and 208, and cavity or chamber 214.

Figure 4:
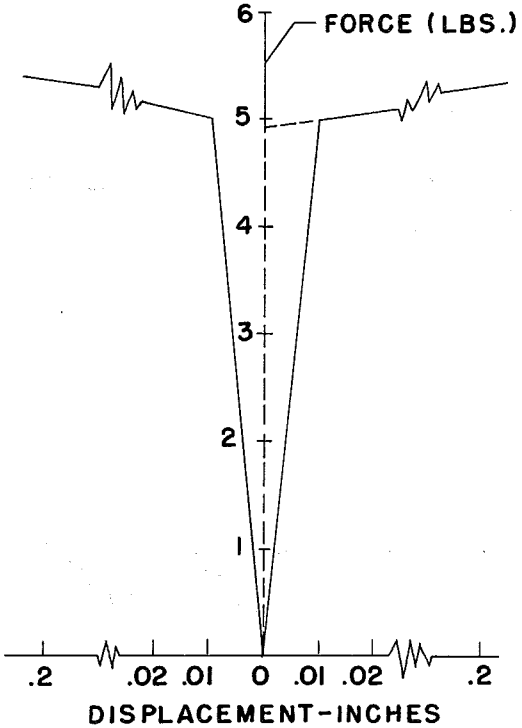
FIG. 4 is an enlarged cross-sectional view of a valve damping arrangement constructed in accordance with the present invention.

When valve spool 36 tends to move to the left in FIG. 4, restrictor-check valve 207 resists the flow of hydraulic fluid from chamber 214 inhibiting motion of spool 36 as a function of its velocity. Restrictor-check valve 208 acts as a relief valve preventing pressure in chamber 214, and thus resisting force on valve spool 36, from exceeding predetermined pressure/force levels. Hydraulic fluid escapes through port 210 and check valve 207 through a suitable return port to a return reservoir. When valve spool 36 moves to the right in FIG. 4, restrictor-check valve 208 resists the flow of hydraulic fluid into chamber 214, inhibiting motion of spool 36 as a function of the velocity. Restrictor-check valve 207 acts as a relief valve preventing negative pressure in chamber 214, and thus resisting force on valve spool 36, from exceeding predetermined pressure/force levels.

The restriction and relief characteristics of valves 207 and 208 implement the damping force characteristics of FIG. 6. Thus, at predetermined frequencies, the damping forces will inhibit movement of spool 36, so that oscillations of member 56 will first move the limited motion yieldable means defined by spring rod 132 at connection 60.

With the arrangement described, damping means G inhibits movement of spool 36 when the mechanical control is inoperative and forces are fed back through summing link 56. This is because at predetermined frequencies damping means G is more powerful than the defined limited motion yieldable means of spring rod 132. Spring rod 132 will simply flex for absorbing and accommodating minor oscillations in the system before valve spool 36 will operate for adding hydraulic fluid energy to the system.

FIG. 5 is a graph showing typical operating characteristics of the yieldable means at connection 60 as described above. Typical displacement of connection 60 is plotted on the horizontal axis in inches. Typical force required to move the yieldable means of spring rod 132 is plotted on the vertical axis in pounds. The dotted line shows operation of a normal system having a biasing means without a limited motion yieldable means. As shown by the dotted line, a force of five pounds would normally be required before any movement of connection 60 would occur. Such a force acting through summing link 56 when the mechanical control is inoperative would normally operate valve C to add hydraulic fluid energy to the system and render the system marginally stable or unstable. With the limited motion yieldable biasing means of the present invention, on the other hand, movement is permitted as shown by the solid graph lines in FIG. 5. The limited motion yieldable means yields under forces of typically 0 to 5 pounds until it bottoms out and biasing means D takes over. This limited yieldable motion occurs under forces less than those necessary to operate valve C at predetermined frequencies so that minor oscillations are absorbed and accommodated by the limited yieldable means without significant motion of the valve C.

FIG. 6 is a graph showing the typical operating characteristic valve damping means G described above. The frequency of the system in hertz is plotted on the horizontal axis, whereas the peak force at typical displacement amplitude is plotted in pounds on the vertical axis. Peak damping force increases as shown by upwardly extending continuing graph line 220. With the combined damping and relief means G of the present invention provided on valve C, the maximum peak force at typical displacement amplitude is limited as shown by horizontal dotted graph line 222.

Figure 7:
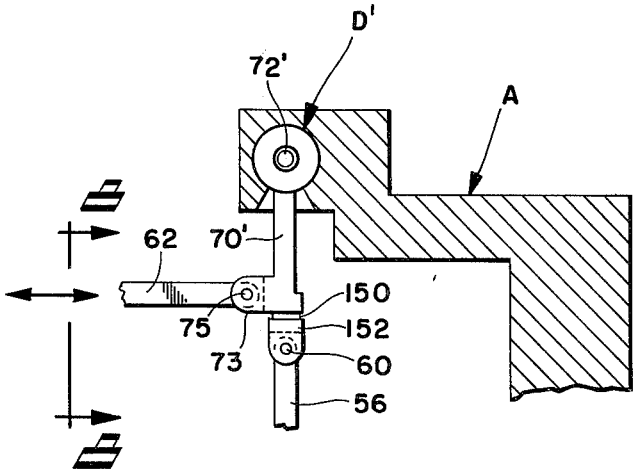
FIG. 7 is a partial schematic view similar to FIG. 1 and showing a modified connection.
Figure 8:
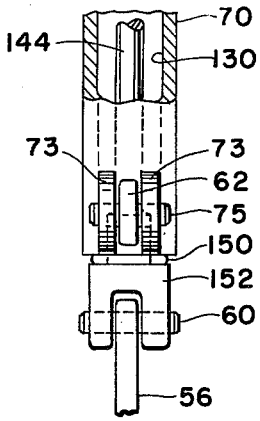
FIG. 8 is a view looking generally in the direction of arrows 8—8 of FIG. 7.

FIGS. 7 and 8 show another arrangement substantially the same as that shown in FIGS. 2 and 3 except that means D′ does not include the resilient biasing means of FIG. 3 so that shaft 72′ is simply an idler and arm 70′ simply a guide having spaced ears 73 between which control link 62 is received and connected by pin 75. The limited motion yieldable means defined by spring rod 144 is now between control input link 62 and summing link 56. When the arrangement of FIGS. 7 and 8 is incorporated in the system of FIG. 1, such system does not have a resilient biasing means for biasing the control means to a passive position. However, the limited motion yieldable means is constructed and operates the same as that shown in FIG. 2 and is operative to provide limited yielding movement of summing link 56 at predetermined frequencies prior to operation of valve C by forces acting through such summing link.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. In a hydromechanical servo system, a hydraulic cylinder containing a piston, valve means for supplying fluid to said cylinder to actuate said piston, damping means for damping operation of said valve means, mechanical control means for operating said valve means, and mechanical feedback means connected between said piston, valve means and control means, the improvement comprising; limited motion yieldable means for providing limited yielding movement of said feedback means at predetermined frequencies prior to operation of said valve means by forces acting through said feedback means.

2. The system of claim 1 further including biasing means for biasing said control means to a passive position.

3. The system of claim 2 wherein said limited motion yieldable means includes means for providing limited yielding movement of said feedback means relative to said biasing means.

4. The system of claim 2 wherein said biasing means includes a crank arm, said limited motion yieldable means being connected between said crank arm and said feedback means.

5. The system of claim 4 wherein said crank arm includes a hollow portion having bottom and outer end portions, and said limited motion yieldable means includes a spring rod positioned in said hollow portion and secured to said bottom portion, said rod having a portion movable relative to said outer end portion of said hollow portion by flexing of said rod.

6. The system of claim 1 wherein said limited motion yieldable means includes an elongated cantilevered spring rod interconnecting said feedback means and mechanical control means.

7. The system of claim 1 wherein said valve means includes a valve spool, and said damping means includes a hydraulic fluid chamber, and restrictor valve means for said chamber providing entrance and escape of hydraulic fluid relative to said chamber under influence of forces applied to fluid in said chamber by said valve spool.

8. The system of claim 1 further including control augmentation means connected with said feedback means for selectively operating said valve means.

9. In a hydromechanical servo system, a hydraulic cylinder containing a movable piston for controlling the position of a controlled member, valve means for selectively supplying fluid to said cylinder to selectively extend and retract said piston, mechanical control input means for operating said valve means, summing link means for providing input and feedback for said system, said summing link means providing a connection between said piston and valve means and being connected with said control input means at an input connection, biasing means for biasing said input connection to a passive position under predetermined biasing force, limited motion yieldable means for providing limited movement of said input connection relative to said biasing means under influence of feedback forces applied to said summing link means, and damping means for damping operation of said valve means during such limited movement of said input connection.

10. The system of claim 9 wherein said valve means includes a valve spool and said damping means includes a hydraulic fluid chamber, and there is a restrictor valve means for said chamber for providing entrance and escape of hydraulic fluid relative to said chamber under influence of forces applied to fluid in said chamber by said valve spool.

11. The system of claim 10 further including control augmentation means for operating said valve means, said control augmentation means being connected with said summing link means and valve means.

12. The system of claim 9 wherein said limited motion yieldable means is between said summing link means and said mechanical control input means.

13. The system of claim 9 wherein said biasing means is connected with said input connection and said limited motion yieldable means is between said biasing means and said input connection.

14. In a hydromechanical servo system, valve means for supplying fluid to a cylinder to actuate a piston, damping means for damping operation of said valve means, summing link means for providing input to said valve means and feedback from said piston, and limited motion yieldable means for providing limited movement of said summing link means under influence of feedback forces applied to said summing link means, said damping means precluding operation of said valve means during such limited movement of said summing link means.

15. The system of claim 14 further comprising biasing means for biasing said summing link means to a predetermined position, said limited motion yieldable means providing limited movement of said summing link means relative to said biasing means under influence of feedback forces applied to said summing link means.

16. The system of claim 14 further comprising control augmentation means connected with said summing link means for operating said valve, said biasing means providing a hard point against which said control augmentation means acts through said summing link means for operating said valve.

17. In a hydromechanical servo system, valve means for supplying fluid to a part of such system and summing means connected with said valve means for providing control input to said system for operating said valve means and for providing feedback for a part of such system, the improvement comprising; valve damping means for damping the movements of said valve means to prevent significant movement thereof at predetermined frequencies without application of relatively high force thereto, and limited motion yieldable means for providing limited movement of said summing means under influence of feedback forces applied thereto without causing significant movements of said valve means.

* * * * *